United States Patent [19]

Young et al.

[11] Patent Number: 4,726,403

[45] Date of Patent: Feb. 23, 1988

[54] TOOL FOR APPLYING CLAMPING BANDS

[75] Inventors: Thomas F. Young, Simi Valley, Calif.; Wayne Wolcott, Inglewood, Ohio

[73] Assignee: Electro Adapter, Inc., Chatsworth, Calif.

[21] Appl. No.: 759,454

[22] Filed: Jul. 25, 1985

[51] Int. Cl.[4] ..... B21F 9/02

[52] U.S. Cl. ..... 140/93.4; 140/123.6

[58] Field of Search ..... 140/93.2, 93.4, 123.5, 140/123.6, 150, 152, 153, 154; 74/585; 81/9.3, 344; 384/37

[56] References Cited

U.S. PATENT DOCUMENTS

| | | | |
|---|---|---|---|
| 1,989,669 | 2/1935 | Harvey | 140/93.2 |
| 2,882,934 | 4/1959 | Gerrard | 140/93.2 |
| 3,782,426 | 1/1974 | Morgan et al. | 140/93.2 |
| 3,837,211 | 9/1974 | Gress et al. | 81/363 |
| 4,047,545 | 9/1977 | Paradis | 140/93.2 |

FOREIGN PATENT DOCUMENTS

| | | | |
|---|---|---|---|
| 1208952 | 1/1966 | Fed. Rep. of Germany | 384/37 |

OTHER PUBLICATIONS

Panduit Pan-Steel Bulletin M-MLT-1, Panduit Corp, 1981.

Panduit Wiring Products Bulletin E-TPS-85, Panduit Corp, Nov. 1984.

*Primary Examiner*—Lowell A. Larson

*Attorney, Agent, or Firm*—Harris, Kern, Wallen & Tinsley

[57] ABSTRACT

A banding tool and method of operation for tightening and securing a band about an article within predetermined tension limits and for automatically locking that tension once the predetermined tension has been attained, which tool includes a receiver element, a first gripping element for incrementally advancing the banding material through the tool, a second gripping element for securing the banding material within the tool as the banding material is being tightened about the article, an actuator unit for predetermining tension limits and for precisely determining when that predetermined band tension about the article has been reached and which automatically locks the tension into the band once that tension is attained about the article, a bending element for bending the banding material after the predetermined tension has been locked about the article, and a cutting member for severing the excess banding material from the band while maintaining the predetermined tension.

29 Claims, 28 Drawing Figures

TOOL FOR APPLYING CLAMPING BANDS

BACKGROUND OF THE INVENTION

The present invention relates to a banding tool and, more particularly, to a banding tool and method of using the banding tool for banding an article to a predetermined band pressure or tension and then automatically locking that band tension about the article.

The ability to tighten and lock a band automatically about an article within predetermined tension limits is a very desirable feature from the standpoint of accuracy and ease of operation. No banding tools are presently known which incorporate these features.

Banding tools are well-known and are used for a wide variety of banding operations. However, a disadvantage of these banding tools is that they are unable to insure consistently that a predetermined band tension is attained, operation after operation. For example, one such tool consists of two rotary wheels with teeth operatively connected to arms operating in a scissors-like manner. Banding material is initially fed between the rotary wheels. The arms are alternatively compressed and released while pulling the banding material into the tool until the banding material has been tightened about the article.

A disadvantage of this type of banding tool is that no mechanism is provided for predetermining a tension limit for the banding material about the article and then once that tension is attained, for automatically locking that tension into the banding material about the article. Basically, with this type of tool, the tension of this banding material about the article is a function of the operator's judgment and experience.

Another form of banding tool incorporates a single gripping element for applying a pulling force to a band but does not provide for any locking at a predetermined tension.

Accordingly, there is a need for a banding tool which provides the ability, independent of the banding tool operator, to band an article at a predetermined tension and then once that predetermined tension is attained, to effect automatic locking on that predetemined tension on the band about the article.

In particular there is a need for a banding tool which can be used in conjunction with shielded electrical cable and cable connectors, including a tool which can tighten and lock a stainless steel band about a woven metal braid over the tubular portion of an electrical connector.

SUMMARY OF THE INVENTION

The present invention provides a banding tool and method of operation designed to satisfy the aforementioned needs. The invention embodies a unique tension actuator unit that is simple, compact and may be utilized over a wide range of predetermined tension ranges. Furthermore, the banding tool of the present invention is totally independent of the operator for repeatedly accurately determining the banding material tension about the article.

Accordingly, the present invention relates to a banding tool for tightening and securing banding material about an article within predetermined tension limits and for locking that tension once the predetermined tension has been attained, which includes means for receiving the banding material, means for incrementally advancing the banding material through the tool, means for securing the banding material within the tool as the banding material is being tightened about an article, means for predetermining tension limits and for precisely determining when that predetermined tension of the banding material about the article has been reached, and means for locking the predetermined tension into the banding material about the article once the predetermined tension is attained about the article.

A further aspect of the present invention relates to providing means for bending the banding material so that after the predetermined tension has been attained and the means for precisely locking has been actuated, the predetermined tension will be maintained.

A still further aspect of the present invention relates to providing a tool which includes means for severing the excess banding material from the band while maintaining the predetermined tension about the article.

While the present invention may be embodied in tools for a plurality of different applications, one example, which was designed for application in aerospace electrical wiring systems, is as a hand operated tool for tightening, locking and trimming a unitary metal band onto a backshell of a connector within a tension range from 75 to 175 pounds. After the tension range has been locked in the band about the connector, the tool bends the excess banding material so that the tension is locked in the band about the backshell. Finally, the tool is used to sever the excess banding material from the band.

Accordingly, it is an object of the present invention to provide a banding tool which may be utilized with a wide variety of banding materials, and to provide a banding tool which allows for accurate predetermined tension limits to be set, and once attained, to effect automatic locking of the predetermined tension into and about an article independent of the banding tool operator.

Other objects and advantages of the invention will be apparent from the following description, the accompanying drawings and the appended claims.

DESCRIPTION OF THE PREFERRED EMBODIMENT

Figure 1:
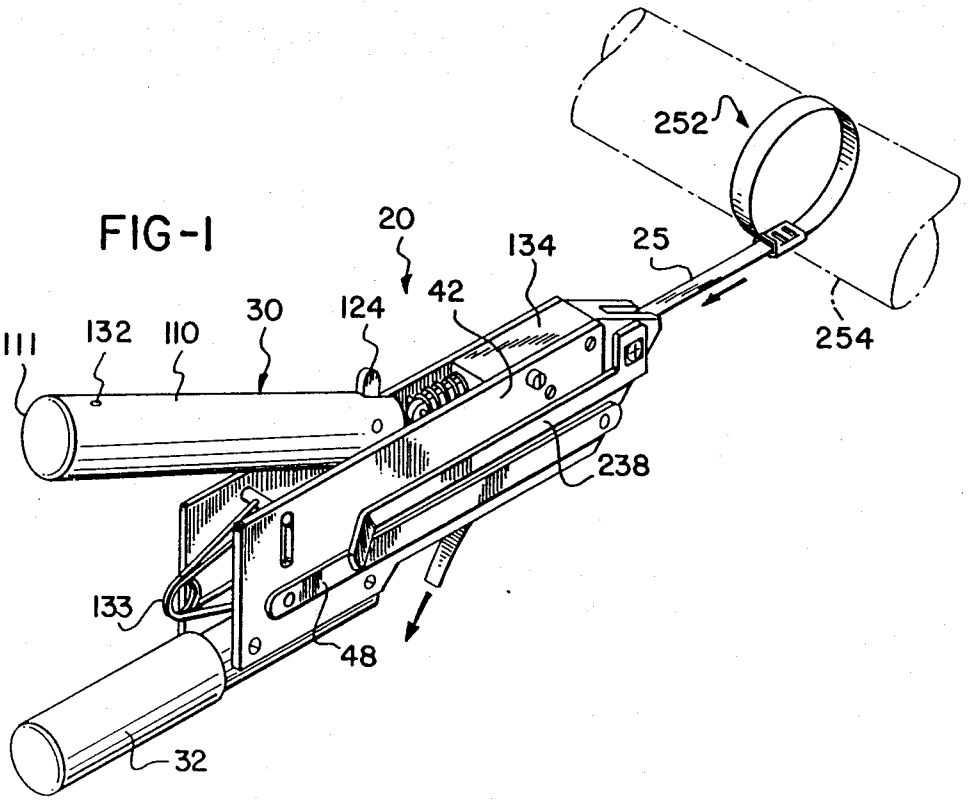
FIG. 1 is a perspective view of a tool incorporating the presently preferred embodiment of this invention.

Referring now to the drawings and specifically to FIGS. 1-6, banding tool 20 consists of the following major elements: banding material receiving housing 22, first banding material gripping element 24 for incrementally advancing the banding material 25 into the tool, second banding material gripping element 26 for preventing the banding material once advanced into the tool from slipping back out, tension actuator unit 28 for setting the predetermined tension and locking the tension on the band about the article once that tension is attained and two scissor grip members 30, 32 for operating the first banding material gripping element 24 and the tension actuator unit 28.

Figure 2:
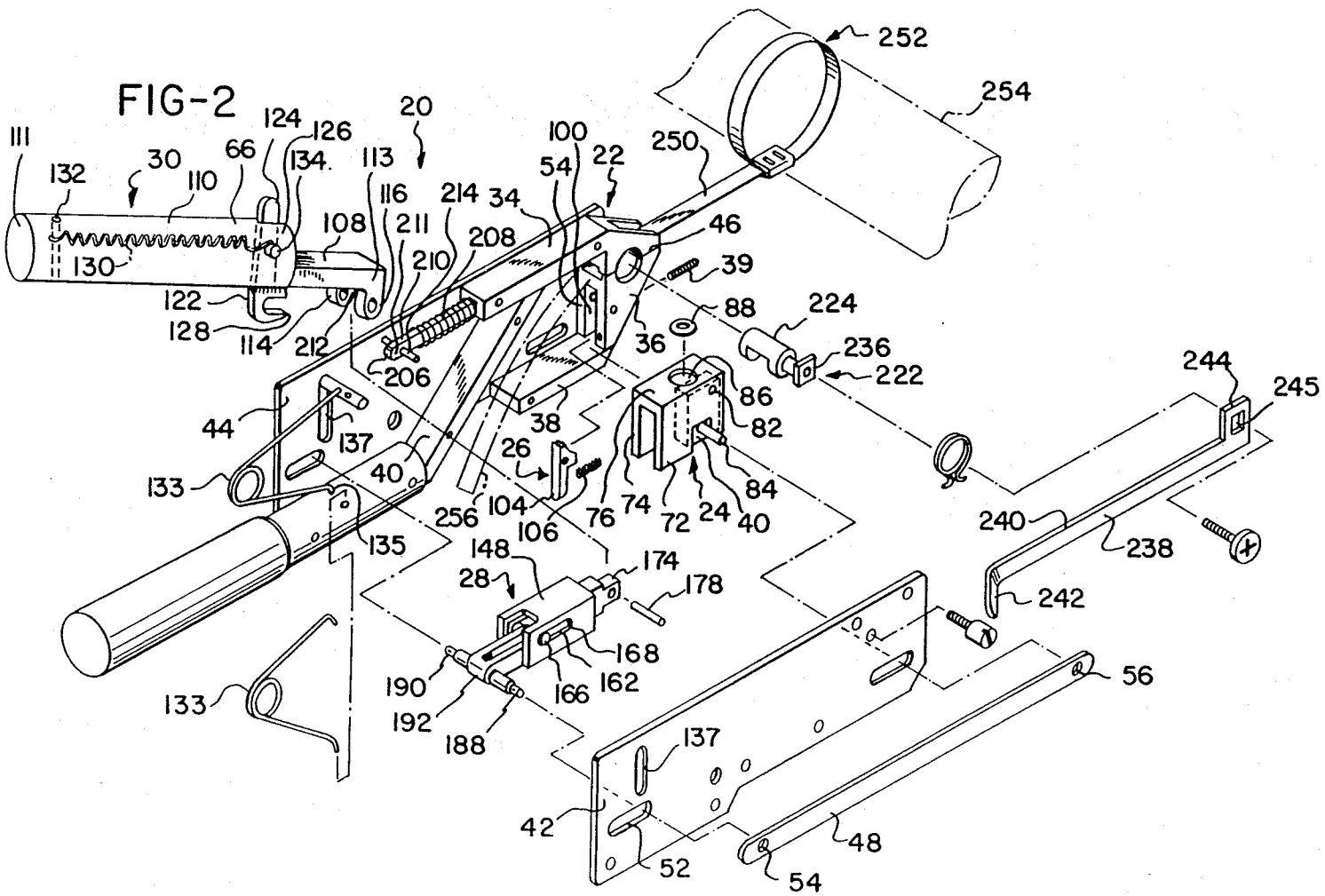
FIG. 2 is an exploded perspective view of the tool of FIG. 1.

Means are provided for receiving and guiding the banding material 25 into banding tool 20. In FIG. 2, banding material receiving housing 22 consists of an upper receiving housing member 34, a lower receiving housing member 36, a lower elongated member 38, a rear elongated member 40 and two side members 42 and 44.

Figure 15:
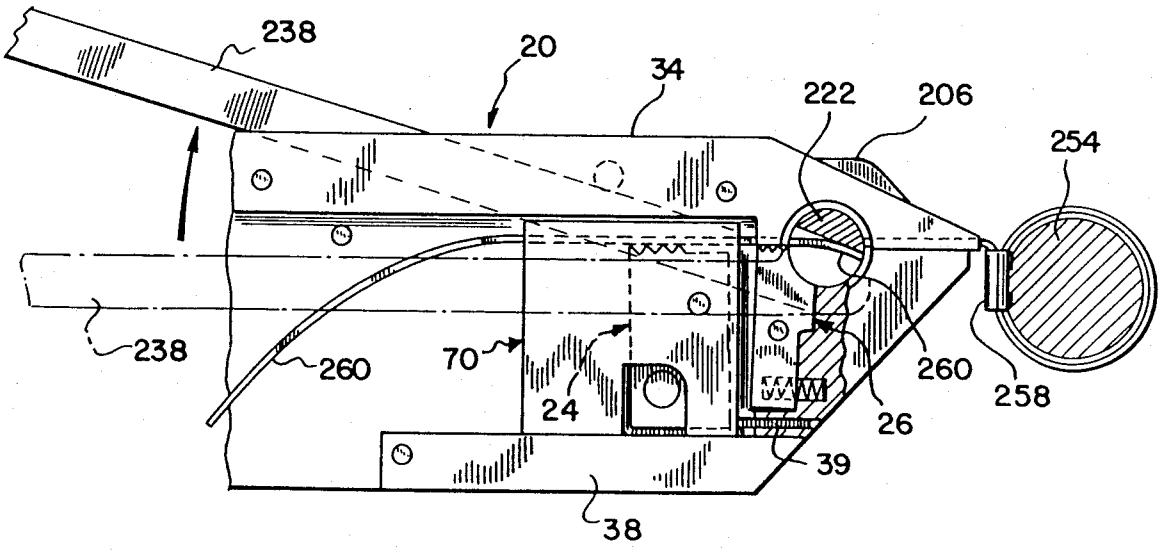
FIG. 15 is an enlarged partial view taken along the lines 1—1 of FIG. 1.

A channel 46 is initially formed between the upper receiving housing 34 and the lower receiving housing 36. The channel 46 can be initially sized to accommodate a plurality of different sized banding materials 25 or once initially sized, the channel 46 can be made adjustable to accommodate a plurality of different sized banding materials 25 smaller than the initial size. As illustrated in FIG. 15, this is accomplished by one or more bores 45 drilled in upper receiver housing 34 and threaded to receive threaded removable screws 54 therein. A plurality of bores can be drilled into upper receiver housing 34, as required.

In the preferred embodiment, the upper and lower housings 34 and 36 are connected to form the channel 46 at their junction. However, it is understood that the banding material receiving housing 22 could consist of only one member or a plurality of members.

Means are provided for making the banding tool 20 rigid and for interconnecting the various housing components. In the embodiment illustrated in FIGS. 1 and 2, this consists of two side members 42, 44 and two identical linking members 48.

As illustrated in FIG. 2, the generally planar side members 42, 44 each have means for connecting them to the other tool components. Each member 42, 44 has two identical rectangular shaped cut-outs 50, 52, front cut-out 50 is located proximate the front end portion of each member 42, 44 and the rear cut-out 52 is located proximate the rear end portion of each member 42, 44. These cut-outs 42, 44 provide for the interconnection of the tension actuator unit 28 with the first gripping element 26 via the two lining members 48. Side member 42 also has a generally circular cut-out 53.

The two side members 42, 44 are connected to the receiving housing 22. The two side walls 42, 44, along with upper receiving member 34, lower receiving member 36, lower elongated member 40 and rear elongated member 38 define an operating channel 54 for the first gripping element 24.

The two linking members 48 are generally elongated rectangles with rounded ends having apertures 54, 56 proximate each end. The specific relationship between the linking members 48, the cut-outs 50, 52, the side walls 42, 44, the actuator unit 28 and the first gripping element 24 will be explained later.

Means are provided for gripping the banding material 25 as it is incrementally advanced through the banding channel 46. In the embodiment illustrated in FIG. 3, first gripping element 24 consists of a generally rectangular gripping member 60 having a plurality of teeth 62 located on upper small surface 64. The teeth 62, preferably made from S7 steel, are located on approximately half of the upper surface 64 of the gripping member 60 and are oriented at approximately a 30° angle with respect to the direction of feed, as indicated by the arrow in FIG. 1, of the banding material 25. The first gripping member 60 has two bores 66, 68 drilled approximately perpendicular between sides 70 and 72 of the rectangular gripping member 60.

A U-shaped gripping member housing 70 (FIGS. 2 and 3) is used to mount the first gripping member 60 inside operating chamber 54. The first gripping member housing 70 consists of two generally rectangular side walls 72, 74 connected by an upper generally rectangular top wall 76. Each housing side wall 72, 74 has a bore 78 drilled therein coinciding with the aforementioned bore 66 and an approximately rectangular cut-out portion 80 in the gripping member 70. Pin joint 82 is inserted through bores 78 and 66 to anchor gripping member 60 inside housing 70. Connecting pin 84 is inserted through cut-out portion 80 and bore 68 to limit the degree of pivot of the gripping member 60 precisely within the housing 70. First gripping member 60 is positioned inside housing 70 so that there is sufficient clearance between teeth 62 and the inside surface 75 of top wall 76 for the banding member to pass smoothly therebetween.

A circular recess 86 is drilled in the outer surface 77 of the top wall 76 of the gripping member housing 70. A tension washer 88 is positioned in the recess 86 for providing drag between the first gripping housing 70 and the upper receiving housing member 34. As the first gripping element 24 is moved within the operating chamber 54 (FIG. 2), the drag provided by this tension washer 88 prevents the gripping member housing 70 from locking up in chamber 54 during operation.

Figures 3, 4, 5, 14:
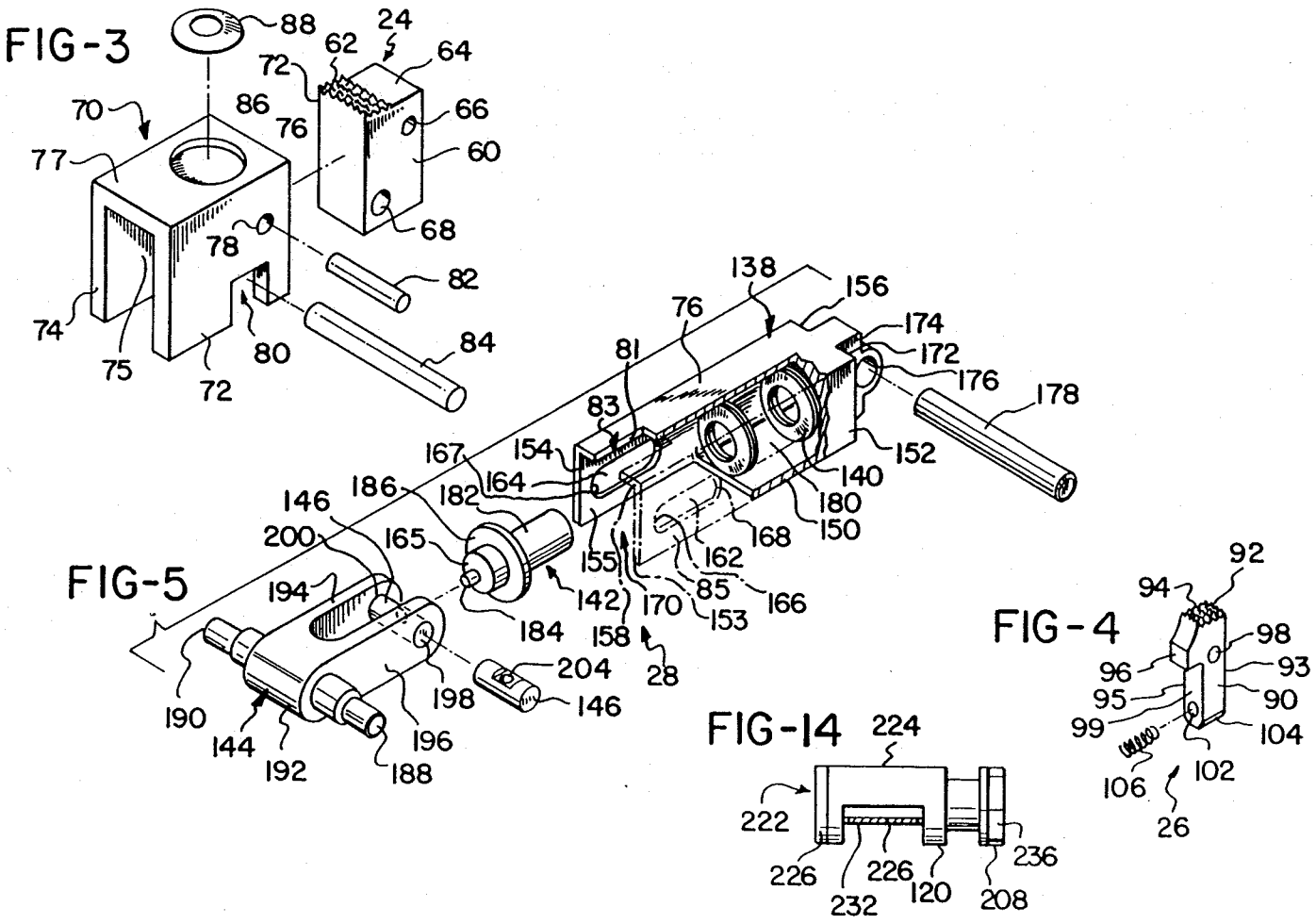
FIG. 3 is an enlarged perspective view of the first gripping element in the tool of FIG. 2.
FIG. 4 is an enlarged perspective view of the second gripping element in the tool of FIG. 2.
FIG. 5 is an enlarged perspective view, partly in section, of the tension actuator unit of FIG. 2.
FIG. 14 is an enlarged elevation view of the cylindrical cutting member showing the recess in registration with the channel and the banding material being fed through the channel.

Means are provided for preventing the banding material 25 advanced into the channel 46, from slipping back between each incremental advancement. In FIGS. 2 and 4, the second gripping element 26 consists of a generally rectangular gripping member 90 having a plurality of teeth 92 on the top end surface 94 and a notch 96 proximate the top end surface 94. The teeth 92, preferably made from S7 steel, are oriented at approximately a 30° angle relative to the direction of feed of the banding material 25.

The second gripping member 90 has a more 98 drilled approximately perpendicularly through the two larger side surfaces 93, 95 and proximate the top end surface 94. The bore 98 is used to pivotally connect the second gripping member 90 inside a cavity 100 (FIG. 2) in the lower housing 36 directly below the banding material feed channel 46.

The second gripping member 90 also has a partial bore 202 drilled on smaller surface 99 perpendicular to the bore 98 located proximate the bottom end surface 104. A spring member 106 is positioned in the partial bore 102 for interaction with the lower housing 36 such that the second gripping member teeth 92 do not engage the banding material 25 as the banding material 25 is being fed into the banding tool 20 but do engage the banding material 25 between each incremental advancement. Thus second gripping element 26 prevents the banding material 25 which has already been fed into the banding tool 20 from slipping back toward the article 254.

Means are provided for incrementally advancing the banding material 25 into the tool 20 by alternately engaging and disengaging the first gripping element 24 and the second gripping element 26 with the banding material 25. In FIGS. 1 and 2 and 5–12, this includes two scissor grip members 30, 32. Upper scissors grip member 30 consists of two portions 108, 110. The first portion 108 is generally planar and has a U-shaped member 112 extending from one end 113. Each leg 114, 116 of U-shaped member 112 has an aperture 118. The first portion 108 is connected to a generally cylindrical second portion 110.

Upper scissors grip member 30 has a hooked-shaped member 122 extending perpendicularly from outside and through both the rectangular shaped portion 108 and the cylindrical shaped portion 110. The hooked-shaped member 122 has the tip 124 extending above the surface of the cylindrical portion 110. Hooked-shaped member 122 housing chamber 126 positions hooked-shaped member 122 such that hook end 128 of hooked-shaped member 122 extends beneath the lower surface 109 of first portion 108.

Hooked-shaped member 122 is spring biased by a spring member 130. The spring member 130 is housed in the cylindrical portion 110 and anchored proximate the far end 111 of member 110 by pin 132. Pin 132 is positioned within cylindrical member 110 essentially parallel to hooked-shaped member 122. The spring 130 is anchored to hook-shaped member 122 by pin 134. Pin 134 is connected to hook-shaped member 122 and is oriented basically perpendicular to the hook-shaped member 122. Spring member 130 biases the hook end 128 of the hook-shaped shaped member 122 toward U-shaped member 112 at the end of first portion 108 of upper scissors grip member 30.

Lower scissor grip member 32 is generally cylindrical shaped and is connected at one end to rear elongated member 40. A spring member 13 is connected to lower scissor grip member at 135 and to both the left and side wall members 42 and 44 at vertical cut-outs 137. Spring 133 biases upper scissor grip member 30 away from lower scissor grip member 32.

Means are provided for setting the predetermined tension limit in each band 252 looped about an article 254 (FIG. 1), and for precisely determining and locking that predetermined tension in the looped band 252 about the article 254 when that tension limit has been attained. In FIGS. 2 and 5, the tension actuator unit 28 consists of an actuator housing 138, a spring member 140 positioned inside the housing 138, a connection member 142, a yoke 144 and a cylindrical pivot pin 146.

As illustrated in FIG. 5, the generally rectangular actuator housing 138 has a generally rectangular upper wall 148, a generally rectangular bottom wall 150, two generally rectangular side walls 152, 154, a generally rectangular end wall 156 and an open end 158. The upper wall 148 has a rectangular cut-out 160 approximately centered between the two side walls 152, 154 and contiguous with the open end 158 of the housing 138. This rectangular cut-out portion 160 interfaces with the hook-shaped member 122 extending through upper scissors grip 30.

The side walls 152, 154 of the actuator housing 138 have approximately identical rectangular cut-out portions 162, 164. The length of these side wall cut-out portions 162, 164 is critical to the operation of the tool 20. Cut-outs 162, 164 must be coordinated with the amount of tension provided by the spring 140 housed in the housing unit 138. The ends 166, 167, 168, 169 of each rectangular side wall cut-out portion 162, 164 are approximately semi-circular in shape.

The bottom wall 150 of the actuator housing 138 is also provided with a large generally rectangular cut-out portion 170. The cut-out portion 170 is contiguous with the open end 158 of the actuator housing 138 and extends approximately half way toward the closed end 156 of the actuator housing 138. The cut-out 170 extends from the inner surface 153 of side wall 152 to the inner surface 155 of side wall 154.

Attached to the outer surface 172 of the end wall 156 of the actuator housing 138 is a pivot housing 174. The pivot housing 174 has aperture 176 for receiving a pin joint 178 to connect the actuator unit 28 operatively to the upper scissor grip 30 and the two side walls 42, 44.

The upper wall 148, the two side walls 152, 154, the bottom wall 150 and the end wall 156 combine to form a generally cylindrical chamber 180 which houses the spring member 140. The spring member 140 is assembled in the housing 138 on a connection member 142. The connection member consists of a cylindrical member 182 having a stud 184 in the center of one end 185 of the member 142 and a collar 186 about the end 185 closest the stud 184.

A U-shaped yoke 144 retains spring member 140 in place in the housing 138. The yoke 144 is connected to both the first gripping element 24 and the upper scissors grip 30. The yoke 144 has connecting pins 188, 190 connecting to the U end 192 of the yoke 144. The connection pins 188, 190 are connected by the links 48 to the first gripping element 24, by the connecting pin 178. The yoke 144 has two legs 194, 196 which extend perpendicular to the two connection pins 188, 190. the two legs 194, 196 of the U-shaped yoke have apertures 198, 200 located proximate the ends remote from the U end 192 of the yoke 144 for receiving a pivot pin 146. The U-legs 194, 196 of the yoke 144 are spaced so that they fit snugly but are freely slidable within the space defined by the inner surface 153, 155 of left and right walls 152, 154 of the tension element housing 138.

Figure 8:
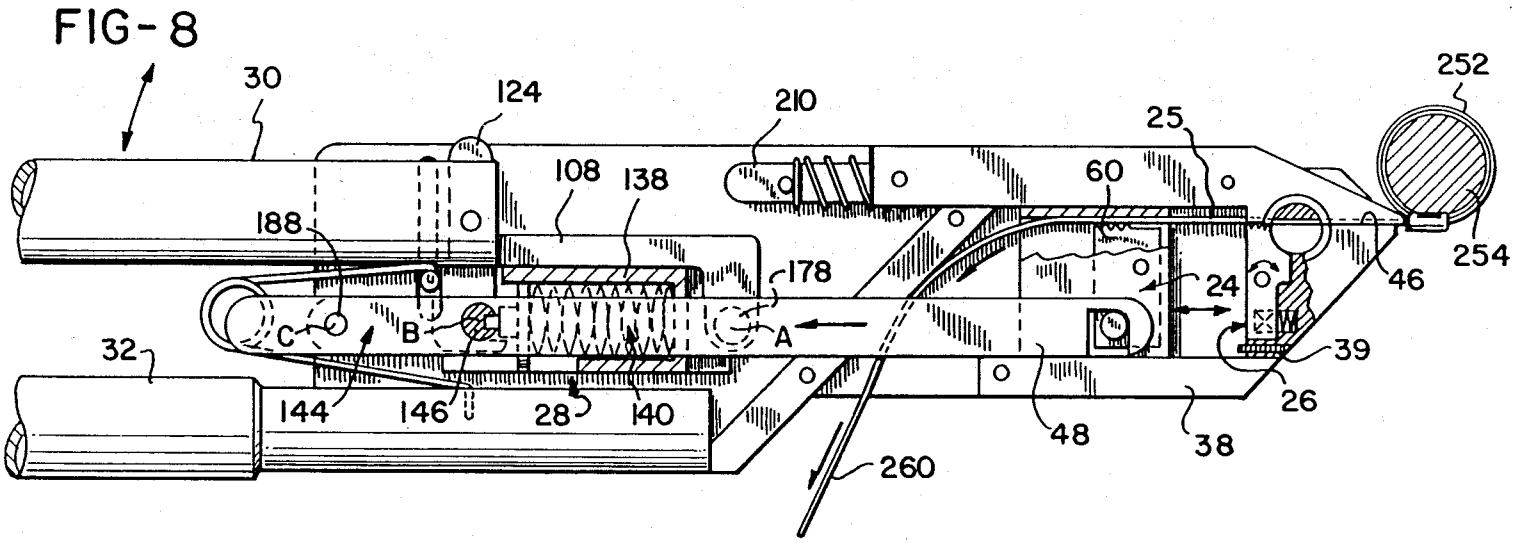
FIG. 8 is a view similar to FIG. 7 illustrating the action of the second gripping member and a tension actuator to pull the banding material tighter about the article.
Figure 6:
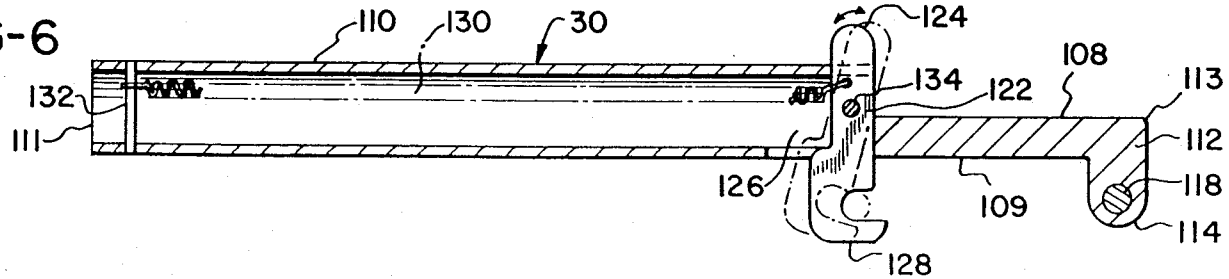
FIG. 6 is an enlarged sectional view of the upper gripping member of FIG. 2.
Figure 7:
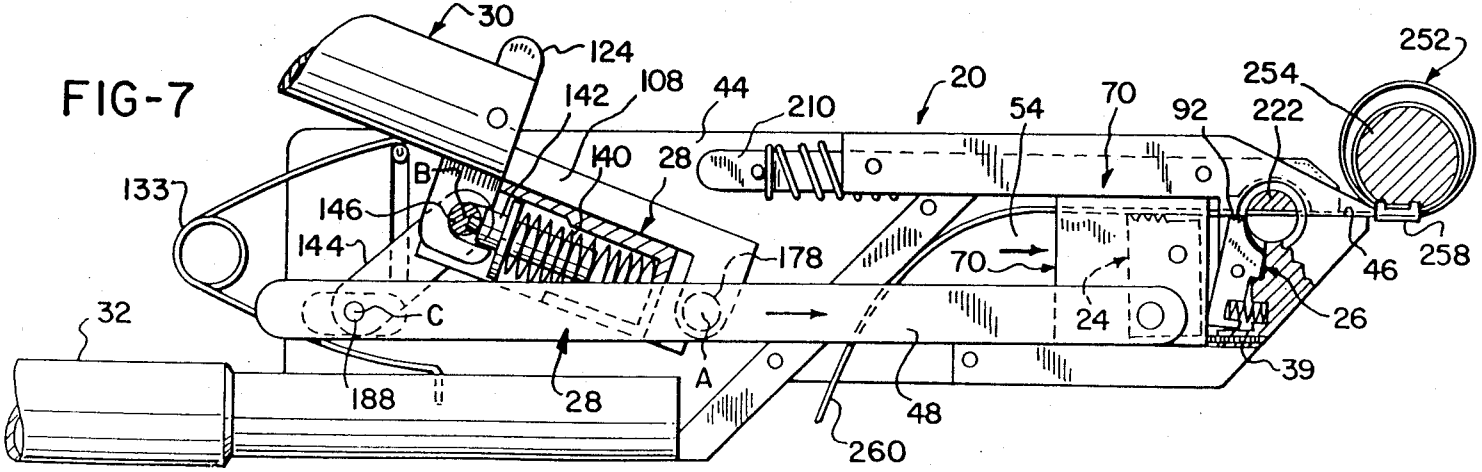
FIG. 7 is a partial sectional side view showing the tool of FIGS. 1–6, prepared for operation.

The cylindrical shaped pivot pin 146 which connects the yoke 144 and the connection member 142 has a recess 204 bored midway on its surface perpendicular to its length. This recess 204 is sized to receive snugly the stud 184 on the end 185 of the connection member 142. The pivot pin 146 extends through the yoke legs 194, 196 and overlaps the rectangular cut out portions 162, 164 in the two side walls 152, 154 of the actuator housing 138 but does not extend beyond the outer limits of the rectangular cut-off portions 162, 164 of the tension housing walls 152, 154. The hook end 128 of hook-shaped member 122 engages pivot pin 146 as shown in FIGS. 6–8.

Means are provided for bending the banding material 25 once the predetermined tension is locked into the band 252 about the article 24. In the embodiment illustrated in FIGS. 2 and 10, bending member 206 consists of a spring member 208 mounted on elongated member 210. The spring 208 biases elongated member 210 in the direction of flow of banding material 25 into tool 20. Two studs 212 and 214 are formed at one end perpendicularly to the surfaces 211 of member 210. Chamfered tip 216, positioned at the opposite end of elongated member 210 from studs 212, 214, is utilized to bend banding material 250. In close proximity to tip 216 is a recess 218.

Bending member 206 is housed in a chamber 220 located in upper receiving housing 34. Chamber 220 extends the entire length of the upper receiving housing 34 and is positioned therein approximately parallel to and above channel 46.

Means are provided for severing the banding material 25 once the banding material has been bent by bending member 206. In the embodiment illustrated in FIGS. 2, 13 and 14, cutting member 222 consists of a generally cylindrical member 224 having a recess 226 extending approximately half way through the cylinder and having sharpened edges 232 and 234. Two end members 226 and 228 are integral with cylindrical member 224. A connecting member 236 is utilized to connect cylindrical member 224 to an actuator lever 238 (FIG. 1). The recess 218 in elongated member 210 cooperates with cylindrical member 224 during the bending operation.

Actuator lever 238 consists of an elongated rectangular member 240 having a curved end portion 242 at one end and a rectangular member 244 having an aperture 245 at the other end. Curved end portion 242 is curved away from side wall 42 of the housing group 22. Cylindrical member 224 of cutting member 222 is connected to rectangular member 244 of actuation lever 238 by inserting connection member 236 into the aperture 265. In an alternative configuration, the cutting member 222 may also function as the second gripping element.

To place banding tool 20 into operation, as illustrated in FIGS. 7–10, a band 252 is positioned around an article 254. After the band tip 256 is inserted into the channel 46, this banding material 25 is hand fed into the tool 20 until it is engageable by the first gripping element 24. Once sufficient banding material 25 has been fed into the channel 46, the tool 20 is operated by compressing the upper scissor grip 30 toward the lower scissor grip 32 in a scissor-like stroke. A plurality of such scissor-like strokes tightens the band 252 about the article 254 to the predetermined tension.

Figure 9:
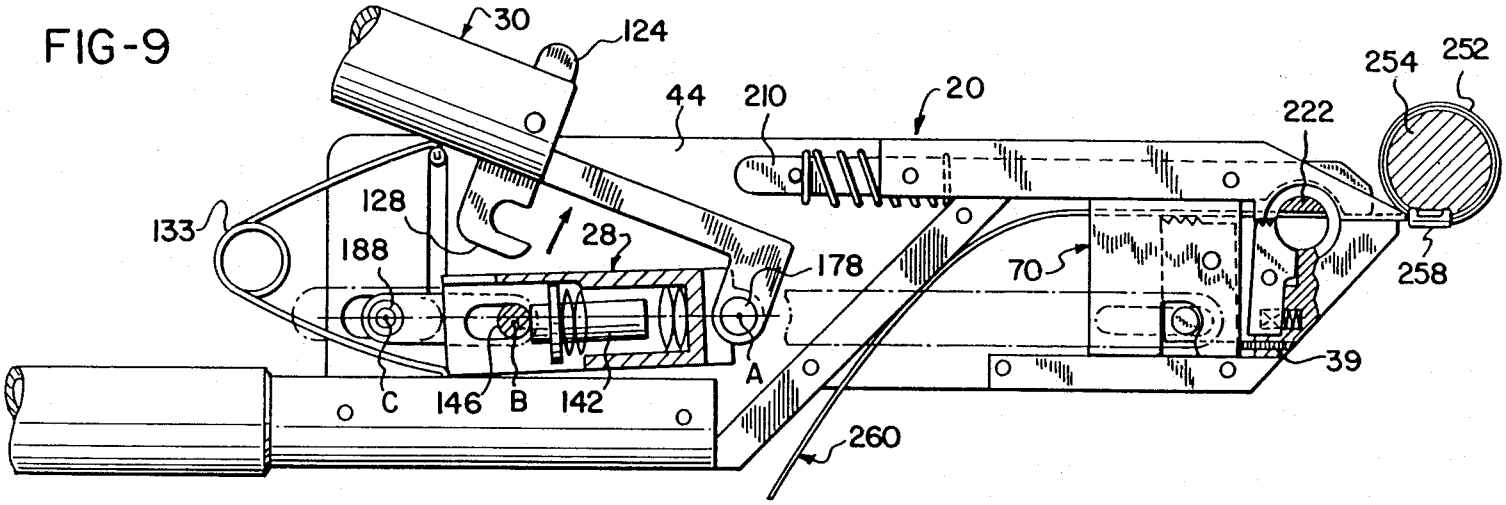
FIG. 9 is a view similar to FIGS. 7 and 8 illustrating the banding material reaching its predetermined tension about the article and the locking of that tension by the actuating unit.
Figure 10:
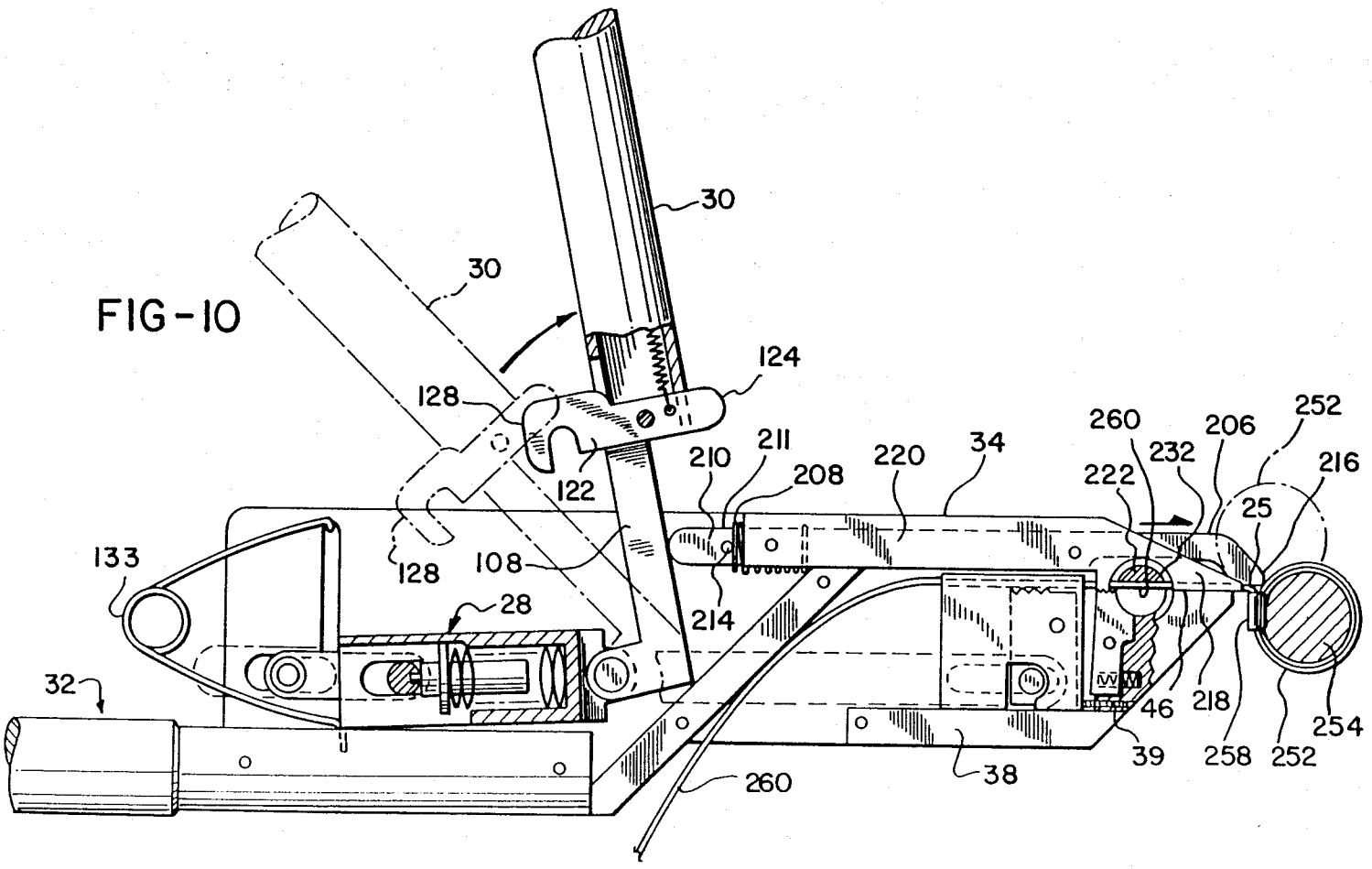
FIG. 10 is a view similar to FIGS. 7, 8, and 9 illustrating the operation of the bending member.
Figure 11:
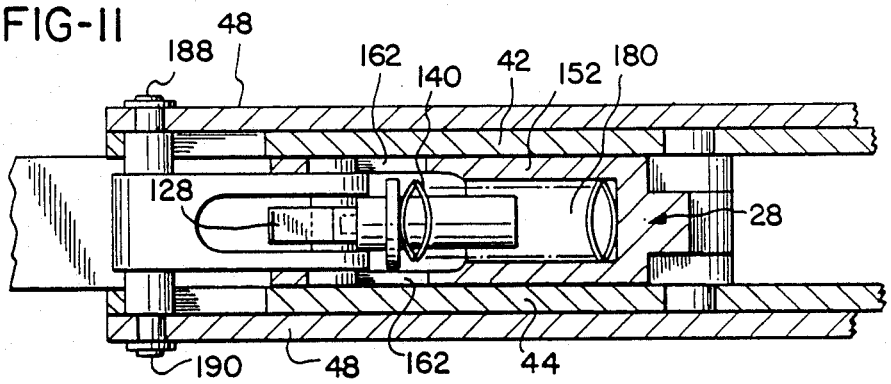
FIG. 11 is a partial sectional top view showing the connection between the hook-shaped member connected to the upper scissors member and the pivot joint which connects the yoke arms and the connecting member prior to the spring member collapsing when the predetermined tension is attained with the tool of FIG. 2.

As best illustrated in FIG. 9, once the predetermined tension about the article 254 has been attained, the upper scissors grip 30 will disengage from the pivot joint 146 of the tension actuator unit 28. Once disengaged from the pivot joint 146, the upper scissor grip 30 is rotated upwardly away from the lower scissors grip 32, as illustrated in FIG. 10, as far as possible. The upper scissors grip 30 will strike the spring biased bending member 206 moving tip 216 into contact with the banding material 25 proximate the front edge of the banding tool 20.

As best illustrated in FIG. 10, this contact between the bending member 206 and the banding material 25 will bend the banding material 25 at approximately a 90° angle. Once the banding material 25 has been bent, the predetermined tension on the band 252 about the article 254 will be maintained by the bend so positioned near the band buckle 258. Specifically, the approximate 90° angle bend is critical to prevent the band 252 from loosening about the article 254 and to prevent the band 252 about the article 254 from slipping back away from the bend, thereby maintaining the predetermined tension about the article 254.

After the banding material 25 has been bent, the upper scissors grip 30 is returned to the position illustrated in FIG. 8 for reengagement with the actuator unit 28. In this position, the hooked-shaped member 122 of upper scissor grip 30 is best positioned for reconnection to the tension actuator unit 28 at the pivot pin 146. If the hooked-shaped member 122 and upper scissor grip 30 were not spring biased, after the tension had been released and the spring 140 returned to its original expanded position in actuator housing 138, it would require considerable pressure to compress the spring 140 in the actuator housing 138 to effect reengagement of hook-shaped member 122 with the pivot joint 146. While it is understood that hook-shaped member 122 can be rigidly affixed to the upper scissor grip member 30, a spring-biased member 112 is preferred in order to reduce tool breakage at this critical connection point.

In order to separate the excess banding material 260 contained in the tool 20 from the band 252 about the article 254, the cutting member 222 actuating lever 238 (FIGS. 1 and 2) is rotated approximately in the same manner as the upper scissors grip 30. This motion rotates one of the cutting member's sharpened edges 232, 234 into contact with the banding material 25, severing it at a predetermined distance from the band buckle 258. The distance from the point of severance to the buckle 258 may be selected such that the remaining banding material 25 extending from the band 252 about the article 254 can be bent back over the band buckle 258, thereby securing the predetermined tension in the band 252 about the article 254.

Once the excess material 260 has been severed from the band 252, the excess banding material 260 which is being fed out from underneath the tool 20 is thrust sharply forward, causing the material 25 to bend about the lower elongated member 38.

To clear the excess banding material 260 from the channel 46, merely compress the scissor grips 30, 32 together in the scissor-like motion so that the teeth 62, 92 disengage from the excess banding material 260. Once all excess banding material 260 has been cleared, it may be discarded. At this point, the tool 20 is ready to begin another banding operation.

It is critical to the operation of the tool 20 that each component part cooperate in a specific manner. As illustrated in FIG. 7, upon engagement of the banding material 25 fed through the channel 46 by the first gripping member 24, the banding tool 20 is prepared for operation. In this position, the first gripping element 24 is all the way to the front of its operating chamber 54, contacting or nearly contacting the second gripping element 26. The second gripping member 26 teeth 92 are engaging the banding material 25 thereby preventing it from being disengaged from the banding tool 20.

Figure 13:
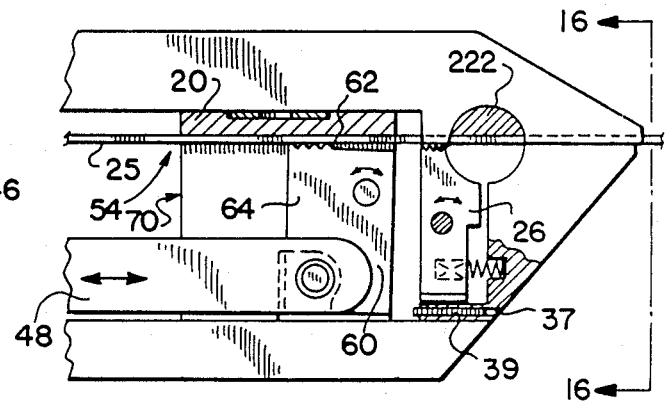
FIG. 13 is an enlarged partial sectional side view showing the detailed inner relationship of the first and second gripping elements of FIGS. 7, 8 and 9.

As best illustrated by FIGS. 8 and 13, during compression of the upper scissors grip member 30 to the lower scissors grip member 32, the first gripping member 60 inside the gripping member housing 70 is rotated slightly so that the gripping member 60 teeth 62 engage the banding material 25. At that point of engagement, the banding material 25 is pulled away from the second gripping element 26 toward the tension actuator unit 28.

As best illustrated in FIGS. 7 and 8, the tension actuator unit 28, in combination with the pair of scissor-like grip members 30, 32 and the first gripping element 24 generate the power to draw the banding material 25 through the channel 46 into the tool 20. At some point during this process once the the predetermined tension is attained, the tension actuator unit 28 in combination with the first gripping unit 24 automatically locks the banding material 25 into position about the banded article 254.

As best illustrated in FIG. 7, during the upstroke of the upper scissor grip member 30, there are three pivot A, B & C. Pivot A is formed by the pin joint 178 connecting the actuator element 28 of the upper scissor grip member 30 and the side walls 42, 44, pivot B is formed by the pivot pin 146 connecting the yoke 144 and the connection member 142, and pivot C is formed by the yoke 144 connecting pins 188, 190, thereby forming a triangular relationship A, B, C.

As is illustrated in FIG. 8, on the downstroke or compression stroke, this triangular relationship A, B, C is converted into a linear relationship A, B, C. The transition from the triangular relationship of FIG. 7 to the linear relationship of FIG. 8 compresses the spring 140 housed in the tension actuator unit housing 138 forcing the yoke 144 rearward in cut-outs 52.

Since the yoke 144 is connected to the first gripping element 24 by linking member 48, this action pulls the first gripping element 24 away from the second gripping element 26 in channel 54. This reaward movement of the first gripping element 24 advances the banding material 25 into the channel 46 thereby tightening the band 252 about the article 254.

Upon release of upside of the upper scissor grip member 30, the tool 20 returns to the position illustrated in FIG. 7 and unless the predetermined tension has been attained or exceeded, the spring 140 inside the tension actuator unit housing 28 returns to its original uncompressed position. The relationship between the three previously defined pivots A, B & C is again triangular as shown in FIG. 7.

Upon return to this position, the first gripping member teeth 62 are again disengaged from the banding material 25. The second gripping member teeth 94 engage the banding mater 25 preventing the banding material from slipping back out of the channel 46 toward the band 252 about the article 254.

Upon the second and each subsequent compression of the upper scissor grip 30, the first gripping member 70 teeth 62 re-engage the banding material 25 and advance the banding material 25, second gripper member teeth 94 disengage the banding material 280 thereby incrementally increasing the tension about the article 254. With each motion, the triangle A, B, C formed by the three pivots transitions from a triangular relationship to a linear relationship since the two links 48 connecting the yoke 144 and the first gripping element 24 act to pull the first gripping element 24 away from the second gripping element 26 in channel 54. During each transition of the three pivots A, B & C from the triangular relationship A, B & C to its linear relationship A, B, C, the band 252 is further tightened about the article 254.

Figure 12:
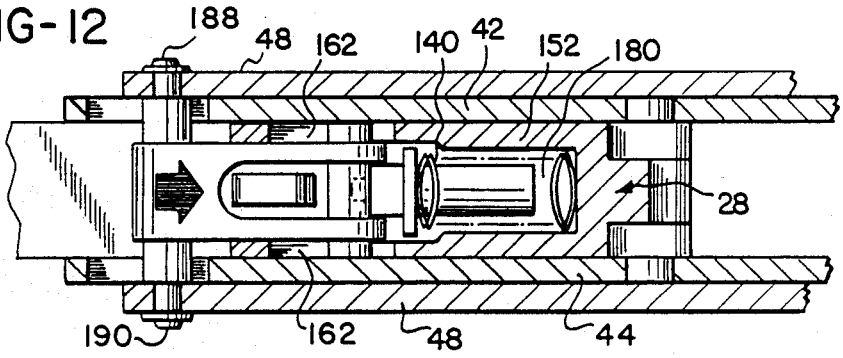
FIG. 12 is a partial sectional top view similar to FIG. 11 but showing the hook-shaped member disengaged from the pivot joint after the spring has collapsed inside the tension actuator housing once the predetermined tension has been attained.
Figure 16A:
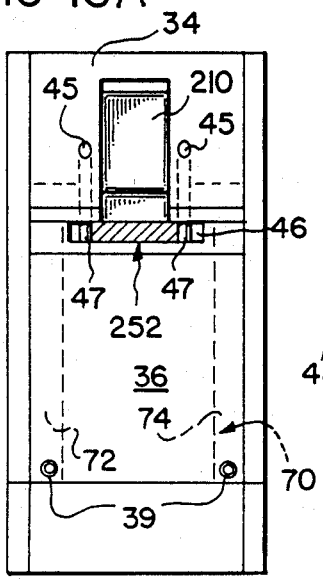
FIG. 16A is an end view taken along the lines 16—16 of FIG. 13.

At some point during one of these scissor-like compression movements, the predetermined tension will be met or exceeded. The spring 140 will collapse inside the tension actuator housing unit 138 and the pivot joint 146 which connects the yoke 144 to the tension housing unit 138 will move all the way forward in the rectangular slots 162, 164 of the side walls 152, 154 as illustrated in FIGS. 9 and 12.

In this position, as best illustrated in FIG. 9, the relationship of the three pivots will once again be triangular A, B, C. However, the pivot B of pivot pin 146 will be approximately 2° below center of a line connecting pivot of connecting pin 178 and pivot C of yoke connecting pins 188, 190.

Once in this position, the collapsed compression spring 140 locks the predetermined tension in band 252 and the upper scissor grip member 30 is simultaneously disengaged from the pivot joint 146 so that upper scissor grip member 30 can be used in the bending operation, as illustrated in FIG. 10.

In the preferred embodiment, due to its unique characterics, a Bellville washer, is utilized as the spring member 140. Since the tension limit of the Belleville washer is determined by one washer and since no matter how many Bellville washers are stacked in series, the tension of all the Bellville washers is the same as a single washer, it is preferered to use the Bellville washer for the spring member 140. However, as discussed earlier, it is possible to utilize any number of spring members such as for example, a coil spring, a rubber block, etc. with the invention.

It should be understood that with various spring members, it is possible to change the predetermined tension by changing springs and also to provide means for adjusting the predetermined tension within a range to a plurality of different tension values without physically changing springs.

DESCRIPTION OF AN ALTERNATIVE EMBODIMENT

A second embodiment of the tool of the invention is shown in FIGS. 16–26. This tool operates generally in a same manner as the tool of FIGS. 1–15, and 16A, and includes a housing 301 with a cover plate 302 attached by screws 303. Opposed openings 304 in the housing and cover plate provide access to a knurled nut 305, which nut is manually rotatable to adjust the predetermined tension of the tool. See FIGS. 16, 17 and 26.

Figures 17, 17A:
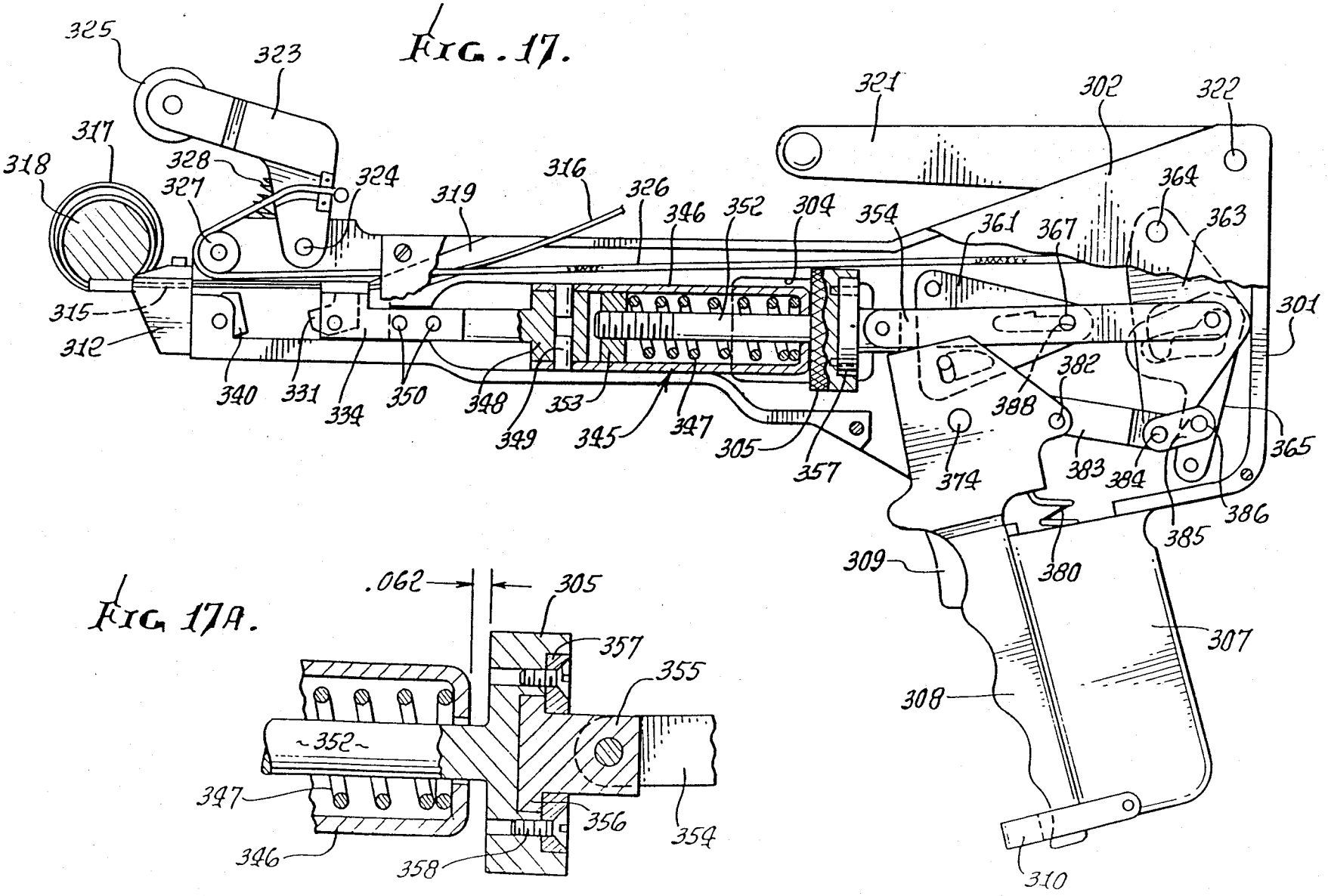
FIG. 17 is a view similar to that of FIG. 16 showing the tool at the end of a pulling stroke.
FIG. 17A is an enlarged view of a portion of FIG. 17.
Figure 18:
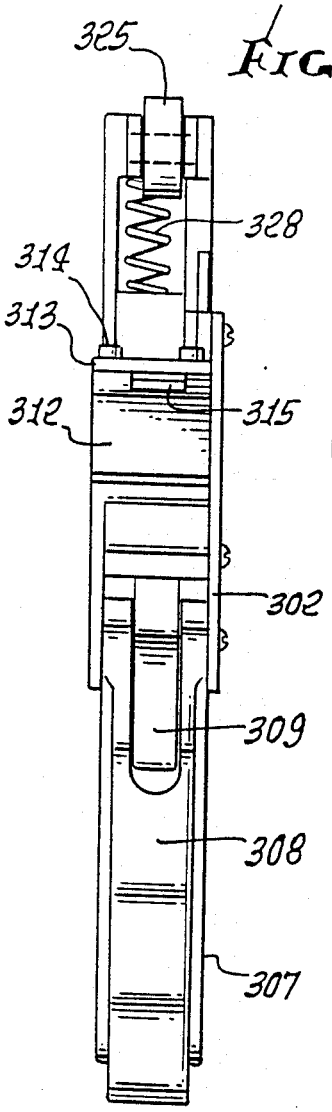
FIG. 18 is a front view of the tool of FIG. 16.

A manual grip 307 is formed with the housing 301. A handle 308 and a trigger 309 are pivotally mounted in the housing and a latch 310 is pivotally mounted at the lower end of the grip 307 for latching the handle 308 in position against the grip 307, as shown in FIG. 17.

A band guide block 312 is carried at the left end of the housing 301, and a plate 313 is attached to the guide block 312 by screws 314. A groove in the block cooperates with the plate to define a band receiving slot 315. See FIGS. 16–18. In use, the free end 316 of a strip of banding material or band 317 about an article 318 to be banded, is inserted into the slot 315 and exits from the tool through another slot 319 in the housing 301.

A lever 321 is mounted on the housing 301 by a pivot pin 302. Another lever 323 is also mounted on the housing by another pivot pin 324. A roller 325 is carried at the free end of the lever 323. The lever 321, 323 are interconnected by a cable 326 which passes over guide rollers 327, with the lever 323 being urged clockwise and the lever 321 being urged counterclockwise by a spring 328 positioned between the lever 323 and the housing 301.

In operation, the nut 305 is rotated to preset the tool to the desired predetermined tension. After the free end 316 of the band is inserted to the position shown in FIG. 16, the handle 308 is manually compressed toward the grip 307. With the embodiment illustrated, each compression stroke moves the band through the tool about one inch. This relative high speed operation is continued until the slack is removed from the band around the article being banded. Then the trigger 309 is actuated and the tool is shifted into a shorter stroke, higher leverage condition, wherein each subsequent compression in the handle 308 to the grip 307 advances the band about one-quarter of an inch.

Figure 16:
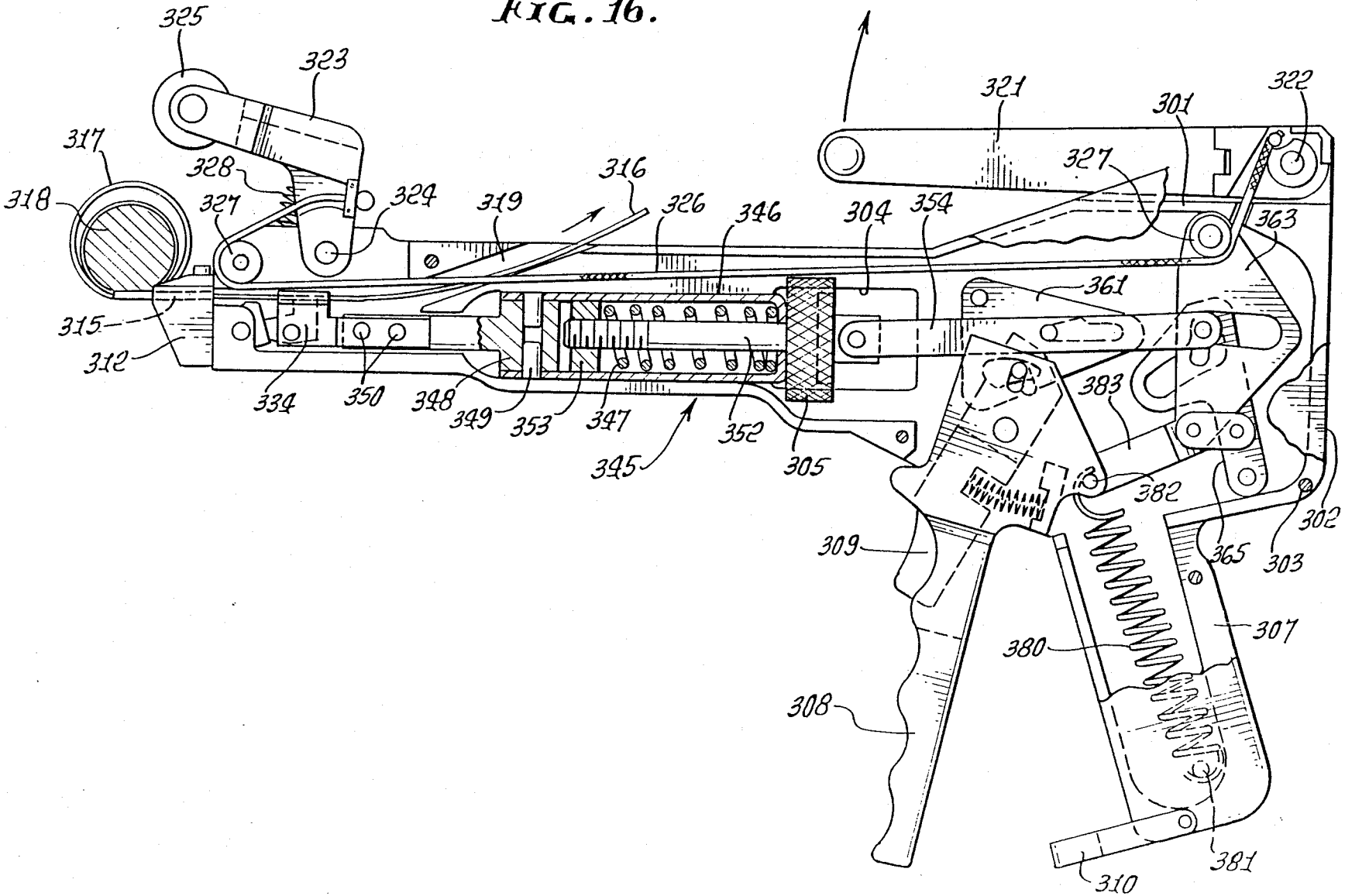
FIG. 16 is a side view, partly in section, of a tool incorporating an alternative embodiment of the invention, with the tool shown at the beginning of a pulling stroke.
Figure 26:
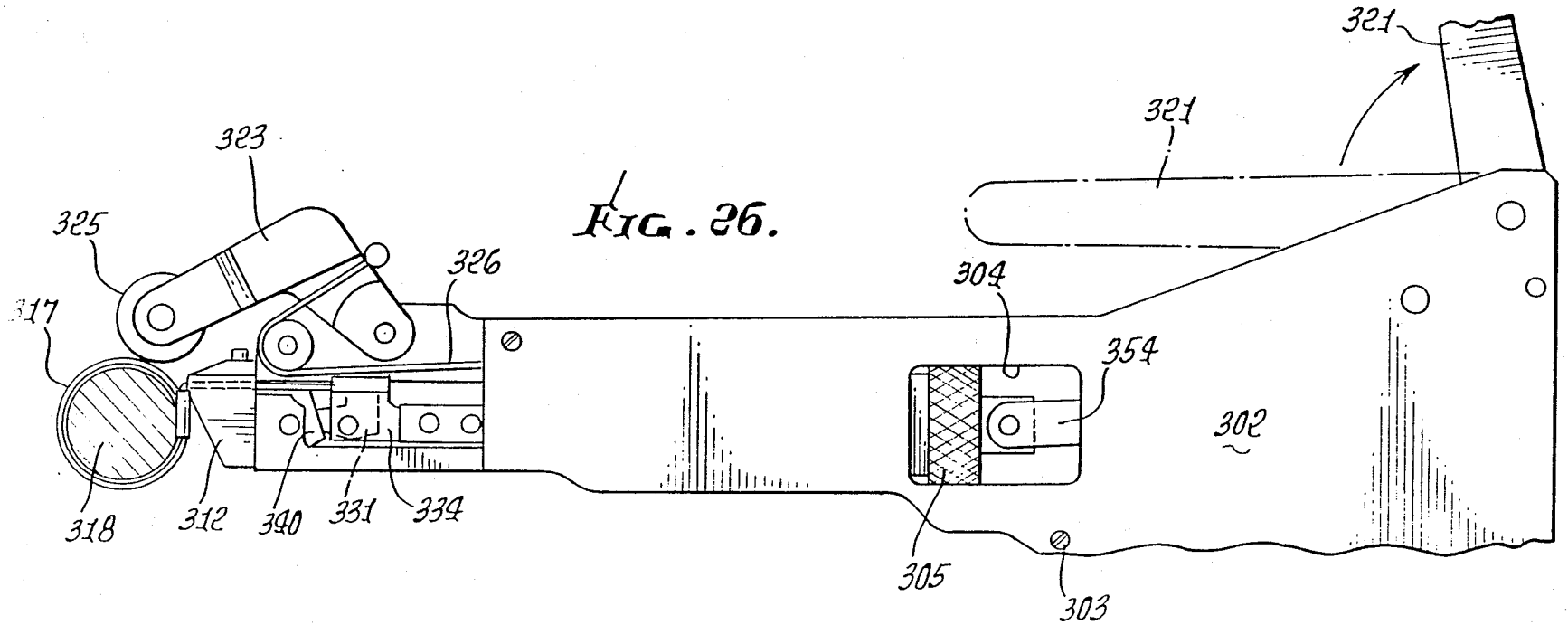
FIG. 26 is a partial view similar to that of FIGS. 16 and 17, illustrating the bending of the band.

Compression strokes are continued until the desired preset tension in the band is reached. At this time, an overcenter toggle mechanism (to be described) is actuated within the tool to lock the tool in the position of FIG. 17, with the latch 310 engaging the handle 308. Then the lever 321 is raised or pivoted clockwise as shown in FIG. 26, thereby pivoting the lever 323 counterclockwise to engage the roller 325 with the banded article and bend the band to about 90°. The lever 321 is then returned to the rest position as shown in FIGS. 16 and 17, with the lever 323 raised out of engagement with the banded article. The latch 310 is pivoted downward, releasing the handle 308 and the tool returns to the condition of FIG. 16. This permits the free-end 316 of the band to be pulled from the tool. The free-end may then be cut off as desired, and the remaining short end at 90° may be folded down to a 180° position if desired.

The banding tool includes first and second gripping elements for engaging the band, pulling the band into the tool, and locking the band. The gripping elements are shown in operation in FIGS. 16, 17 and 26 and in greater detail in FIGS. 20–22.

A first gripping member 331 is pivotally mounted on a pin 332 mounted in spaced arms 333 of a coupling member 334. The first gripping member 331 is T-shaped as viewed in FIG. 22, with a depending boss 335 for receiving the pin 332. A spring 336 is positioned about the pin 332 adjacent the boss 335 and between the housing 301 and the gripping member 331 for urging the gripping member counterclockwise as viewed in FIG. 20. Preferably one or more teeth are provided at the upper portion of the first gripping member 331 for engaging the band 317, with the teeth pressing the band against a back up plate 338 carried by the coupling member 334.

Figure 20:
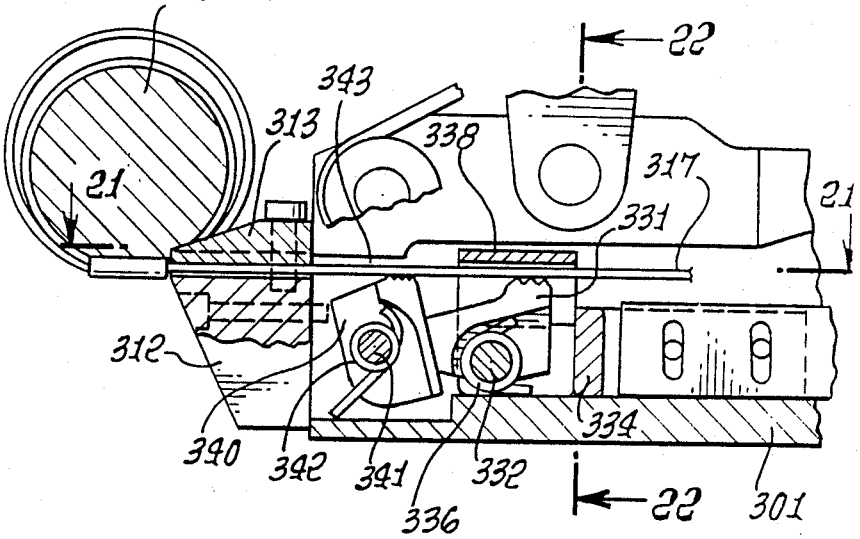
FIG. 20 is an enlarged sectional view of the left portion of the tool of FIG. 16.
Figure 21:
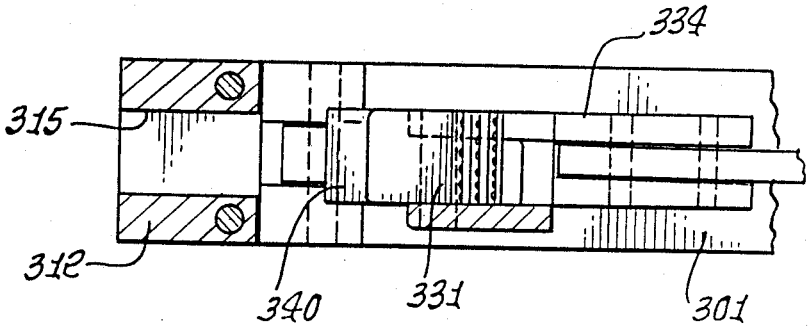
FIG. 21 is a sectional view taken along the line 21—21 of FIG. 20.
Figure 22:
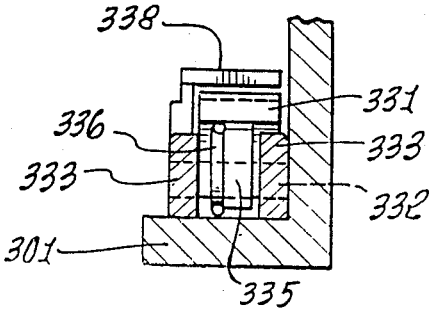
FIG. 22 is a sectional view taken along the line 22—22 of FIG. 20.
Figure 19:
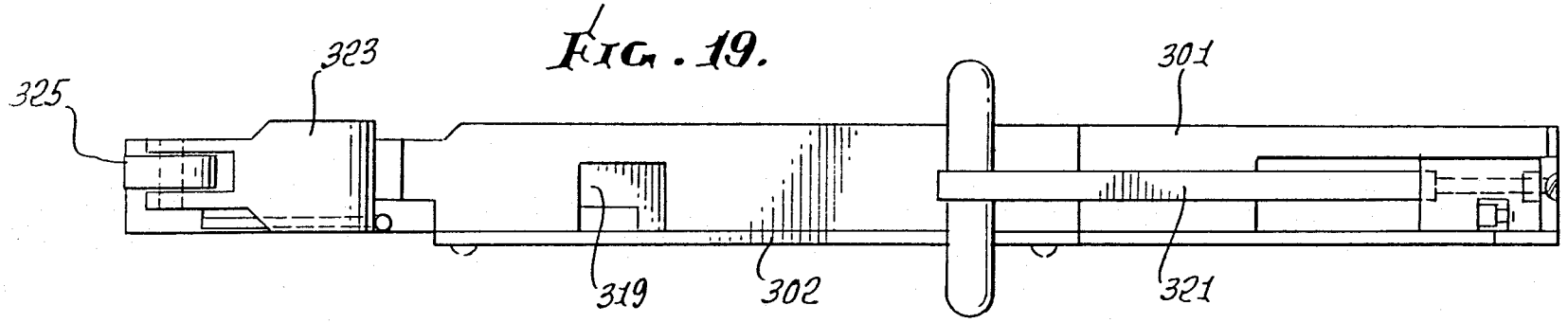
FIG. 19 is a top view of the tool of FIGS. 16 and 17.

A second gripping member 340 is pivotally mounted in the housing 301 on pin 341, with a spring 342 positioned about the pin and engaging the second gripping member and housing for urging the second gripping member counterclockwise as viewed in FIG. 20. The second gripping member 340 also preferably has one or more teeth for engaging the band 317.

In operation, the coupling member 334 is moved to the right during a pulling stroke. The first gripping member 331 engages the band 317, pulling the band to the right. As the band moves to the right, it slides past the second gripping member 340. When the movement to the right ceases, the second gripping member grips the band against the housing at location 343 in order to lock the band in place. When the handle is released, the coupling member 334 moves to the left from the position of FIG. 17 to the position of FIGS. 16 and 20, with the first gripping member 331 sliding along the band. At the end of this movement to the left, the left face of the first gripping member 331 engages the right face of the second gripping member 340, causing the second gripping member to rotate clockwise and release the grip on the band, with the first gripping member now engaging the band. The tool is now ready for another pulling stroke. The pulling strokes are repeated until the predetermined tension is obtained.

A tension actuator unit shown generally at 345 in FIGS. 16, 17 and 17A, provides for determining when the desired tension in the band is achieved. The tension actuator includes a housing 346 for retaining a spring 347. A coupling member 348 is fixed in the left end of the housing 346 by pins 349. This coupling member 348 is connected to the coupling member 334 by pins 350 (FIG. 16). The knurled nut 305 has a shaft 352 which passes through an opening in the right end of the tension actuator housing 346. The spring 347 is positioned about the shaft 352 and is held in place by the nut 353 threaded onto the end of the shaft 352, with the nut 353 sliding in the actuator housing 346.

A link 354 is connected to the knurled nut 305 by a boss 355 which has a flange 356 positioned in an opening in the nut 305. A retainer ring 357 is mounted in the nut 305 by screws 358, thereby clamping the boss 355 in place while permitting rotation of the nut 305.

During the initial pulling strokes, the tension actuator housing 346 and the knurled nut 305 move as a unit, with the spring 347 holding the nut against the housing as shown in FIG. 16. Then when the tension in the band reaches the preset figure, the spring 47 compresses, permitting the nut 305 to move to the right relative to the housing 346 as shown in FIG. 17A. This action triggers the over-center mechanism and shifts the tool to the position shown in FIG. 17, with the first gripping member locked into engagement with the band. This permits the bending operation without loosening of tension on the banded article.

Figure 23:
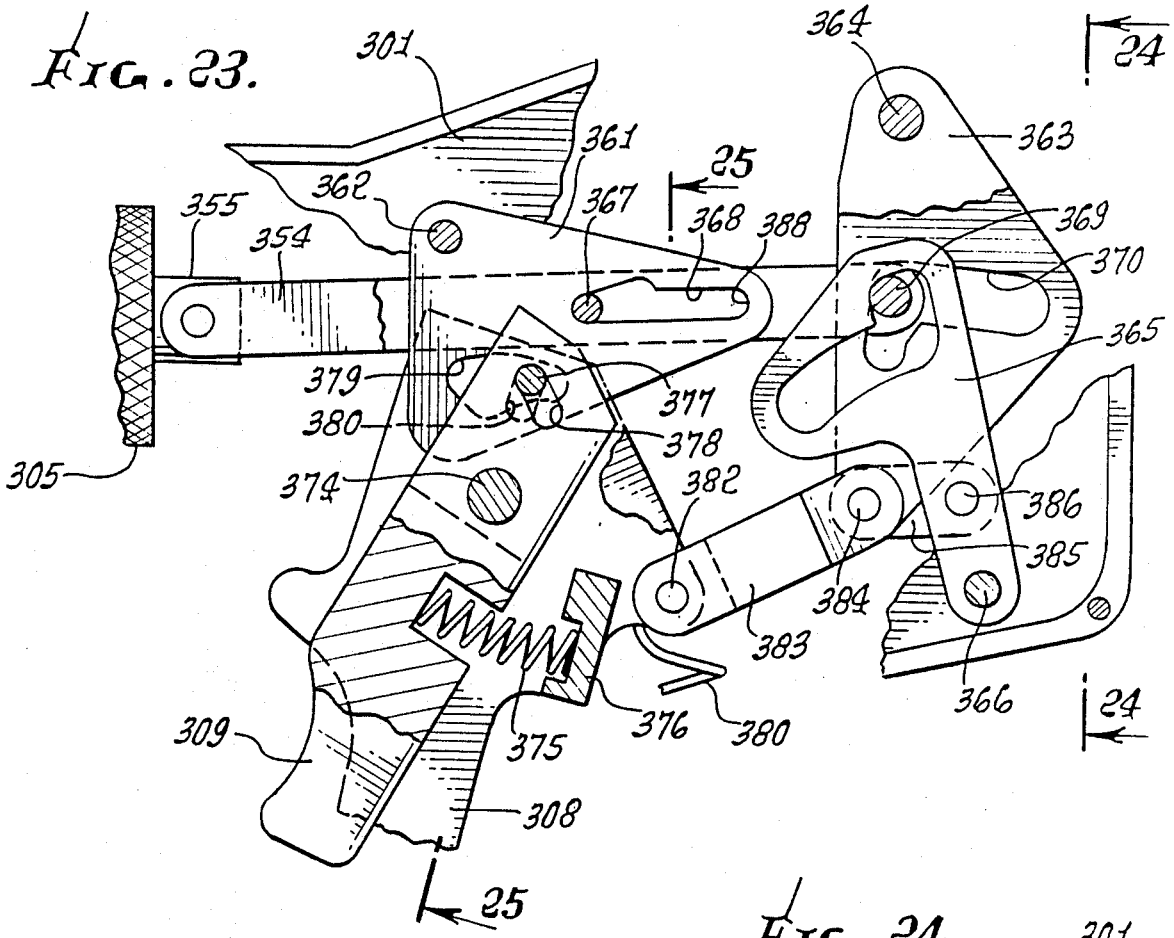
FIG. 23 is an enlarged sectional view of the right portion of the tool of FIG. 16.
Figure 24:
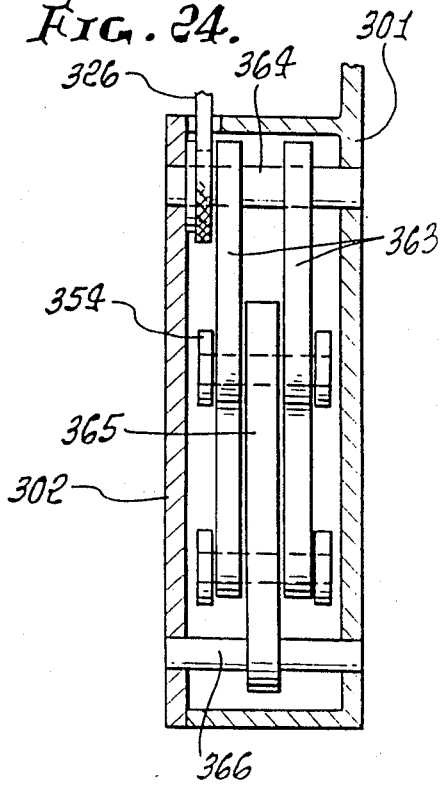
FIG. 24 is a sectional view taken along the line 24—24 of FIG. 23.
Figure 25:
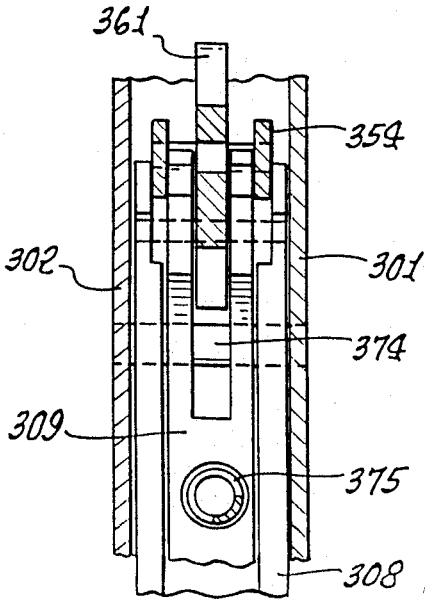
FIG. 25 is a sectional view taken along the line 25—25 of FIG. 23.

The arrangement for shifting from the long-stroke to the short-stroke operation and for the over-center toggle is shown in FIGS. 16 and 17, and in greater detail in FIGS. 23-25. A place 361 is pivotally mounted in the housing on a pin 362, another plate 363 is mounted in the housing on a pin 364, and a third plate 365 is mounted in the housing on a pin 366. A pin 367 carried on the link 354 engages the plate 361 at an opening 368. Another pin 369 carried by the link 354 engages the plate 363 at an opening 370, and engages the plate 365 at another opening 371.

The trigger 309 is pivotally mounted on the handle 308 by a pin 374, with a spring 375 between the trigger 309 and a housing boss 376, urging the trigger clockwise as viewed in FIG. 23. A pin 377 rides in slots 378 and 380 in the trigger 309 and handle 308, respectively, and in an opening 379 in the plate 361.

A tension spring 380 is connected between the grip 307 and the handle 308 at pins 381, 382, urging the handle 308 to the outward or clockwise rotation position as shown in FIG. 16. The handle 308 is connected to the plate 363 by a link 383 between the pin 382 and another pin 384. The plate 365 is connected to the plate 363 by another link 385 between the pin 384 and pin 386.

The mechanism is shown in the long-stroke configuration in FIG. 23. When the handle 308 is compressed against the grip 307, the handle rotates counterclockwise on the pin 374. This motion drives the link 383 to the right, rotating the plate 363 counterclockwise and the plate 365 clockwise. The plates 363, 365 engage the pin 369 of the link 354 and move the link to the right. When the handle 308 is released, the mechanism returns to the position of FIG. 23.

The mechanism is switched to the short-stroke condition by squeezing the trigger 309 and engagement of the pin 377 in the slot 378 causes the plate 361 to rotate clockwise and rotates the link 354 clockwise. Then the travel of the link 354 is limited by engagement of the pin 367 with the slot 368 at the surface 388 as seen in FIGS. 17 and 25.

When the predetermined tension is reached, the nut 305 and link 354 move away from the actuator housing 346, as shown in FIG. 17A. This motion permits the pin 368 to move further to the right than it had during the preceding compression strokes. This additional motion of the pin 369, which in turn causes the pin 384 to move downward. The links 383 and 385, pivoting on pins 382, 384 and 386, function as an over-center toggle mechanism. During the pulling strokes performed by compressing the handle 308 against the grip 307, this toggle mechanism remains in the up position as shown in FIGS. 16 and 23. However, after the predetermined tension is reached, the pin 84 moves downward and the toggle mechanism goes over-center to the position shown in FIG. 17, thereby locking the mechanism at the predetermined tension. The tool is now ready for the bending operation as previously described.

While the method herein described, and the forms of apparatus for carrying this method into effect, constitute preferred embodiments of this invention, it is to be understood that the invention is not limited to this precise method and form of apparatus, and that changes may be made in either without departing from the scope of the invention, which is defined in the appended claims.

We claim:

1. An apparatus for tightening and securing banding material about an article within predetermined tension limits, said apparatus having a first longitudinal axis and said banding material including a strap with a buckle at one end of the strap and with the strap positioned around the article and passing through the buckle leaving the other end of the strap free, said apparatus comprising:

means for setting a predetermined tension range;

means operatively connected to said setting means for receiving and guiding said free end of said banding material along said first axis with said means for receiving and guiding engaging said buckle;

means operatively connected to said advancing means, for securing said banding material within said apparatus as said banding material is being incrementally advanced;

means operatively connected to said advancing means, for precisely determining when said predetermined tension of said banding material about said article is reached; and means operatively connected to said advancing means for automatically locking and maintaining said banding material about said article when said band tension reaches said predetermined tension, with said apparatus positioned away from said article and engaging said banding material only at said buckle and free end leaving said banding material in direct contact with said article about the entire periphery of said article, said means for precisely determining said predetermined tension of said banding material about said article further comprising:

a tension actuator unit having a tension actuator housing with a second longitudinal axis parallel with said first axis, said housing being operatively connected to said means for securing said banding material; and at least one spring member operatively positioned within said actuator housing for exerting a spring force along said second axis, 2. The apparatus as recited in claim 1 further comprising means for bending said banding material after said predetermined tension has been locked about said article.

3. The apparatus as recited in claim 2 further comprising means for severing the excess banding material from said band about said article.

4. The apparatus as recited in claim 3 wherein said apparatus means for receiving and guiding includes at least one housing member having a channel formed therein, and said means for severing further comprises:

at least one cylindrical member having a recess with sharpened edges formed thereon, said cylindrical member being operatively positioned within said apparatus receiving housing, said recess operatively cooperating with said channel thereby providing for the advancement of said banding material through said channel; and an actuating lever operatively connected to said cylindrical member, said actuaing lever being operative to rotate said cylindrical member such that said recess is moved out of alignment with said channel thereby causing one of said sharpened edges to contact said banding material such that said banding material is severed from said band about said article.

5. The apparatus as recited in claim 3 further comprising means for adjusting the predetermined tension of said setting means.

6. The apparatus as recited in claim 2 wherein said means for bending said banding material further comprises at least one bending member, said bending member being operatively positioned inside a bore formed in said apparatus housing, said bending member being spring biased in the direction of feed of said banding material proximate the point at which said banding material enters said apparatus, said bending member contacting said banding material such that said banding material is bent at approximately a 90° angle to said direction of feed.

7. The apparatus as recited in claim 2 wherein said means for bending said banding material further comprises:

a bending member pivotally mounted on said apparatus housing adjacent said means for receiving and guiding, said bending member being spring biased in the direction away from said banding material;

a lever pivotally mounted on said apparatus housing; and means interconnecting said lever and said bending member for pivoting said bending member to contact said banding material proximate the point at which said bending material enters said apparatus, said bending member contacting said banding material such that said banding material is bent at approximately a 90° angle to said direction of feed.

8. The apparatus as recited in claim 1 wherein said means for receiving and guiding said banding material further comprises at least one housing member, said housing member having a channel formed therein and operatively connected to said means for incrementally advancing said banding material, said channel having an opening for receiving said banding material.

9. The apparatus as recited in claim 8 wherein said channel further comprises:

means for adjusting the size of said channel to receive a plurality of different sized banding materials.

10. The apparatus as recited in claim 9 wherein said means for adjusting comprises:

at least one threaded bore, said bore being located on said receiving member above said channel opening; and a screw member, said member being removably insertable into said bore to selectively enlarge or reduce the size of said channel.

11. The apparatus as recited in claim 1 wherein said means for incrementally advancing said banding material further comprises:

means for advancing said banding material at a first rate and at a second rate; and means for selecting said first rate or said second rate.

12. The apparatus as recited in claim 1 wherein said means for incrementally advancing said banding material further comprises:

at least two grip members; and means for operatively connecting said grip members to said apparatus, with at least one of said grip members being pivotable about said apparatus.

13. The apparatus as recited in claim 12 wherein said means for precisely determining said predetermined tension of said banding material about said article further comprises:

at least one connection member, said spring member being operatively positioned on said connection member within said housing; and a pivoting link means, said connection member being operatively connected to said link means, said link means being operatively connected to at least one of said grip member, said link means being operable to compress said spring member inside said tension actuator housing when said predetermined tension is attained on said banding material about said article.

14. The apparatus as recited in claim 13 whererin said tension actuator housing is operatively connected to at least one of said grip members, and said pivoting link means includes a yoke engageable with said grip member, with said predetermined tension causing said spring member to collapse inside said actuator housing when said banding material tension reaches said predetermined tension, and said yoke being disengageable from said grip member when said predetermined tension is attained.

15. The apparatus as recited in claim 13 wherein said pivoting means includes an over-center toggle member, with said predetermined tension causing said spring member to compress inside said actuator housing when said banding material tension reaches said predetermined tension, and said link means and said connection member moving relative to said actuator housing to move said toggle member over-center.

16. The apparatus as recited in claim 1 wherein said means for incrementally advancing said banding material further comprises a grip and a handle, with said grip fixed to said apparatus and with said handle pivotally mounted in said apparatus.

17. The apparatus as recited in claim 16 wherein said means for incrementally advancing said banding material further comprises:

means for advancing said banding material at a first rate and at a second rate; and means for selecting said first or said second rate, said means for selecting including a trigger pivotally mounted on said handle.

18. The apparatus as recited in claim 17 further including:

first, second and third links; and first, second and third plates pivotally mounted in the apparatus housing;

with said first link connected to said means for securing said banding material within said apparatus, and having means for engaging said first plate and for engaging said second and third plates;

with said second link connected between said handle and said second plate;

with said third link connected between said second plate and said third plate;

with said second and third links interconnected at said second plate to provide an over-center toggle;

with said first plate having first and second surfaces for engaging said first link, with said first link normally engaging said first surface; and with said trigger including means engaging said first plate and when actuated, moving said first plate to engage said first link in said second surface.

19. The apparatus as recited in claim 1 wherein said means for securing said banding material as said banding material is being advanced into said apparatus further comprises at least two gripping elements, with one of said gripping elements being operative to increase the tension of said banding material about said article, and with the second of sid gripping elements being operable to prevent said banding material from losing said tension about said article after said banding material has been incrementally advanced and before the next incremental advancement.

20. The apparatus as recited in claim 10 wherein the first of said gripping elements further comprises:

a gripping member having a plurality of saw like teeth, said gripping member having bores for receiving at least one pin joint and at least one connecting pin; and a gripping member housing, said housing having at least two side portions operatively connected by a top portion, each of said side portions having bores for receiving at least one pivot pin and at least one connecting pin, said gripping member being pivotally connected to said two side portions of said housing by said pivot pin, said bores for receiving said connecting pin being designed for precisely controlling the degree of movement of said gripping member within said housing, said gripping member housing having a recess positioned on the top surface of said top portion, said apparatus having an apparatus housing member with said gripping member operatively positioned within said apparatus housing member such that said gripping member housing is moveable as a unit within said apparatus to tighten said banding material about said article.

21. The apparatus as recited in claim 20 wherein when said banding material is being tightened about said article, said first gripping member teeth engage said banding material, and when said banding material is not being tightened about said article, said first gripping member teeth are out of engagement with said banding material.

22. The apparatus as recited in claim 20 wherein said first gripping element further comprises a spring washer member, said washer being operatively positioned within said bore on said top surface of said top of said gripping member housing, said washer maintaining tension drag between said gripping member housing and said apparatus housing member during movement of said gripping member housing within said apparatus.

23. The apparatus as recited in claim 19 wherein said first of said gripping elements further comprises:

a gripping member having an upper surface with a plurality of saw like teeth and a depending boss having a bore for receiving a connecting pin; and a spring means positioned in engagement with said gripping member and said apparatus about said connecting pin for urging said teeth into engagement with said banding material, said gripping member being operatively positioned within said apparatus such that said gripping member is movable within said apparatus to tighten said banding material about said article.

24. The apparatus as recited in claim 19 wherein said apparatus means for receiving and guiding includes at least one housing member having a channel formed therein, and the second of said gripping elements further comprises at least one gripping member operatively connected to said apparatus receiving housing, said gripping member being spring biased such that when said banding material is being advanced through said channel, said gripping member does not engate said banding material, and when said banding material is not being advanced into said apparatus channel, said gripping member does engage said banding material thereby maintaining said tension in the band about said article.

25. The apparatus as recited in claim 19 wherein the second of said gripping elements further comprises a gripping member pivotally connected to said apparatus receiving housing, said gripping member being spring biased toward engagement with said banding material, said gripping member having a surface engageable with said one gripping element for pivoting said gripping member against said spring bias and out of engagement with said banding material.

26. An apparatus for tightening and securing banding material about an article within predetermined tension limits, said apparatus comprising:

at least one upper housing member and at least one lower housing member, said housing members being operatively connected at the juncture of said upper and said lower housings, said juncture forming a channel, said channel being operative for receiving said banding material, said channel extending through said juncture, said channel being adjusted to receive a plurality of different sized banding material;

at least two scissors grip members, said members being operatively connected to said apparatus, at least one of said scissors grip members being pivotable about said connection to said apparatus;

a first gripping element, said first gripping element further comprising:

a first gripping member having a plurality of gripping teeth, said first gripping member having at least two bores for receiving at least one pin joint and at least one connection pin, a gripping member housing, said housing having two rectangular shaped side portions operatively connected by a rectangular shaped top portion, said first gripping member being pivotally connected to said two side portions of said gripping member housing, said housing having means for limiting the degree of pivot of said first gripping member within said housing in cooperation with said connecting pin, said gripping housing having a circular recess on the outer surface of said top portion, said gripping housing and said first gripping member being movable as a unit within said apparatus to incrementally advance said banding material into said apparatus such that when said banding material is being advance into said apparatus, said gripping teeth engage said banding material whereby said material is tightened about said article and when said handing material is not being advanced into said apparatus, said first gripping member teeth do not engage said banding material, and a spring washer member, said washer being positioned in said circular recess of said top portion for maintaining tension drag between said gripping member housing and said apparatus housing member during operation of said apparatus; a second gripping element further comprising:

a second gripping member having a plurality of gripping teeth on its top surface, said second gripping member having a bore drilled through its two larger side surfaces, said bore being proximate said teeth, said second gripping member being pivotably connected to said lower housing member by a connecting pin inserted through said bore, said second gripping member having a center bore on its smaller side surface proximate the receiving housing and remote from said teeth, and a spring member for biasing said second gripping member such that when said banding material is being advanced, said gripping teeth do not engage said banding material, and when said banding material is not being advanced into said apparatus, said second gripping member teeth engage said banding material such that said banding material is prevented from losing tension about said article, said spring member being positioned in said counter bore on said side of said second gripping member;

a tension actuator for precisely determining the tension of and locking said banding material into position about said article once said predetermined tension on said article is attained further comprising:

a rectangular shaped actuator housing, said housing being operatively connected to at least one of said scissors grip members and to said first gripping element, at least one spring member operatively positioned within said actuator housing, a cylindrically shaped connecting member having a stud and a collar for operatively positioning said spring member within said housing, and a U-shaped pivoting yoke operatively connected to said connecting member and to at least one of said scissors grip members, said yoke being operable to completely compress said spring member inside said actuator housing when said predetermined tension is attained on said banding material being tightened about said article, said tension causing said spring member to collapse inside said actuator housing thereby locking said predetermined tension in said banding material about said article when said banding material tension reaches said predetermined tension thereby allowing said yoke to disengage from said scissor grip member;

a rectangular bending member positioned inside a bore in said upper housing and having a spring for biasing said member in the direction of feed of said banding material, said bending member being operative to contact said banding material proximal the point at which said banding material enters said channel, said bending member contacting said banding material such that said banding material is bent at approximately a 90° angle to said direction of feed near said point at which said banding material enters said channel;

a cylindrical member having a recess with sharpened edges formed thereon, said cylindrical member being operatively positioned such that in its normal position said recess operatively cooperates with said channel thereby providing for the advancement of said banding material through said channel; and an actuating lever connected to said cylindrical member, said actuating lever rotating said cylindrical member out of said normal position such that said recess is moved out of alignment with said channel, said rotation severing said band about said article from said excess banding material.

27. An apparatus for tightening and securing banding material about an article within predetermined tension limits, said apparatus comprising:

an apparatus housing including means defining a channel which is operative for receiving said banding material;

a grip and a handle, with said grip fixed to said apparatus housing and with said handle pivotally mounted in said apparatus housing;

a first gripping element, said first gripping element further comprising:

a first gripping member having an upper surface with teeth means and a depending boss having a bore for receiving a connecting pin, and a spring means positioned in engagement with said first gripping member and said apparatus housing about said connecting pin for urging said teeth means into engagement with said banding material, said first gripping member being operatively positioned within said apparatus such that said first gripping member is movable within said apparatus to tighten said banding material about said article;

a second gripping element, said second gripping element further comprising a second gripping member pivotally connected to said apparatus housing, said second gripping member being spring biased toward engagement with said banding material, said second gripping member having a surface engageable with said first gripping member for pivoting said second gripping member against said spring bias and out of engagement with said banding material;

a tension actuator unit having a tension actuator housing operatively connected to said second gripping element;

at least one spring member operatively positioned within said actuator housing;

at least one connection member, said spring member being operatively positioned on said connection member within said actuator housing;

a pivoting link means, said connection member being operatively connected to said link means, said link means being operatively connected to at least one of said grip members, said link means being operable to compress said spring member inside said tension actuator housing when said predetermined tension is attained on said banding material about said article, said pivoting link means further comprising:

first, second and third links, and first, second and third plates pivotally mounted in said apparatus housing, with said first link connected to said connection member, and having means for engaging said first plate and for engaging said second and third plates, with said second link connected between said handle and said second plate, with said third link connected between said second plate and said third plate, with said second and third links interconnected at said second plate to provide an over-center toggle, with said first plate having first and second surfaces for engaging said first link, with said first link normally engaging said first surface, and with said trigger including means engaging said first plate and when actuated, moving said first plate to engage said first link with said second surface;

a bending member pivotally mounted on said apparatus housing adjacent said channel, said bending member being spring biased in the direction away from said banding material;

a lever pivotally mounted on said apparatus housing; and means interconnecting said lever and said bending member for pivoting said bending member to contact said banding material proximate the point at which said bending material enters said channel, said bending member contacting said banding material such that said banding material is bent at approximately a 90° angle to said direction of feed.

28. A method for tightening and securing a band about an article within predetermined tension limits, comprising the steps of:

positioning a band around an article to be banded;

engaging the tip of the band and inserting the tip of the band into a banding tool until sufficient material has been inserted to engage a first gripping element;

compressing an upper scissors grip toward a lower scissors grip in a scissors-like motion stroke, with the upper scissors grip in engagement with a tension limiting unit;

repeating the scissors-like motion stroke until said band tightens about said article to said predetermined tension;

once the predetermined tension about the article has been attained, and the upper scissors grip has been disengaged from the tension limiting unit, rotating the upper scissors grip upwardly away from the lower grip as far as possible;

striking a bending member with the upper scissor grip;

propelling the bending member into contact with the band near the front edge of the banding tool to bend the band;

after the band has been bent, returning the upper scissors grip to its original position for reengagement with the tension limiting unit;

rotating a cutting member actuating lever upwardly from the lower scissors grip thereby severing the free end of the band from the band about the article near the front end of the banding tool;

returning the actuating lever to its original position;

grasping the severed excess band being fed out from underneath the tool and thrusting it sharply forward;

repeatedly compressing the scissors grips together in the scissors-like motion so that the severed band disengages from the teeth of the gripping members; and discarding the severed band.

29. A method for tightening and securing a band about an article within predetermined tension limits, comprising the steps of:

positioning a band around an article to be banded;

engaging the tip of the band and inserting the tip of the band into a banding tool until sufficient material has been inserted to engage a first gripping element;

compressing a moving grip toward a fixed grip in a compressing motion stroke;

repeating the motion stroke until the band tightens about the article to said predetermined tension;

once the predetermined tension about the article has been attained, and the moving grip has been locked against the fixed grip, rotating a lever away from the tool as far as possible;

moving a bending member with the lever into contact with the band near the front edge of the banding tool to bend the band;

after the band has been bent, returning the lever to its original position; and removing the band from the tool.

* * * * *